US005701730A

United States Patent [19]

Kennedy et al.

[11] Patent Number: 5,701,730

[45] Date of Patent: Dec. 30, 1997

[54] INCANDESCENT MANTLES

[75] Inventors: Brian Steven Kennedy, Manchester; Peter Hayhurst, Bury, both of England

[73] Assignee: TBA Industrial Products Limited, Manchester, England

[21] Appl. No.: 621,470

[22] Filed: Mar. 25, 1996

Related U.S. Application Data

[63] Continuation-in-part of Ser. No. 117,194, filed as PCT/GB92/00432, Mar. 11, 1992, abandoned.

[30] Foreign Application Priority Data

Mar. 14, 1991 [GB] United Kingdom ..... 9105396

[51] Int. Cl.[6] ..... D02G 3/02; D02G 3/06

[52] U.S. Cl. ..... 57/224; 57/210; 57/229; 57/904

[58] Field of Search ..... 57/6, 207, 208, 57/210, 229, 904, 232, 224, 230; 431/100; 428/377

[56] References Cited

U.S. PATENT DOCUMENTS

| | | | |
|---|---|---|---|
| 2,449,595 | 9/1948 | Ellis | 154/43 |
| 2,506,706 | 5/1950 | Colle | 67/98 |
| 3,729,920 | 5/1973 | Sayers et al. | 57/144 |
| 3,870,590 | 3/1975 | Hurwitz | 161/92 |
| 3,913,309 | 10/1975 | Chiarotto | 57/144 |
| 4,299,884 | 11/1981 | Payen | 428/377 |
| 4,381,639 | 5/1983 | Kress | 57/229 |
| 4,470,251 | 9/1984 | Bettcher | 57/210 |
| 4,500,593 | 2/1985 | Weber | 428/257 |
| 4,670,327 | 6/1987 | Weber | 428/257 |
| 4,921,756 | 5/1990 | Tolbert et al. | 428/373 |
| 4,927,698 | 5/1990 | Jaco et al. | 428/198 |
| 4,936,085 | 6/1990 | Kolmes et al. | 57/210 |
| 4,958,485 | 9/1990 | Montgomery et al. | 57/210 |
| 5,141,542 | 8/1992 | Fangeat et al. | 57/224 |

FOREIGN PATENT DOCUMENTS

| | | | |
|---|---|---|---|
| 906247 | 12/1945 | France . | |
| 2306957 | 11/1976 | France | 43/4 |
| 2853208 | 6/1979 | Germany . | |
| 271241 | 8/1989 | Germany | 57/230 |
| 18173 | 1/1914 | United Kingdom . | |

*Primary Examiner*—William Stryjewski
*Attorney, Agent, or Firm*—Synnestvedt & Lechner

[57] ABSTRACT

An incandescent mantle tie cord comprises a continuous multifilament first core of a refractory fiber, a second core of another continuous multifilament yarn and an outer sheath of staple fibers wrapped about said first and second cores.

7 Claims, 1 Drawing Sheet

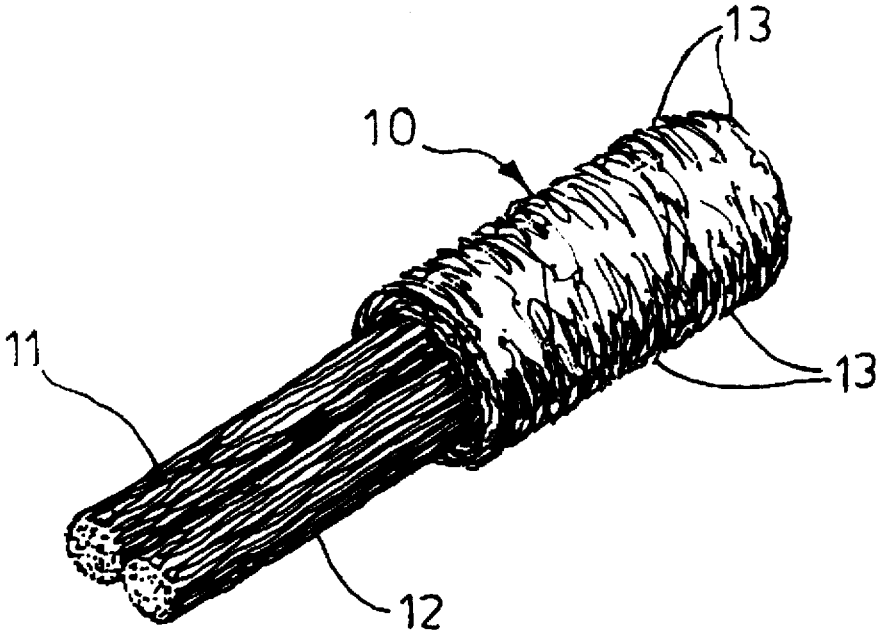
13
10
11
13
12

INCANDESCENT MANTLES

CROSS REFERENCE TO RELATED APPLICATION

This application is a continuation-in-part of Ser. No. 08/117,194, filed as PCT/GB92/00432, Mar. 11, 1992 now abandoned.

BACKGROUND OF INVENTION

1. Field of the Invention

This invention relates to incandescent mantles for use in gas fired lanterns. A mantle for these purposes consists essentially of a bag which is secured over a gas supply jet, combustion taking place on the surface of the mantle, the structure of which is raised to white hot temperatures very rapidly.

2. Description of the Related Art

Mantles are made from flammable carrier yarns which are impregnated with metal salts which on heating are converted to refractory oxides. For example, calcium salts were used, but recently more exotic metal oxides are commonly employed. It will be noted that structural integrity is important, although it is normally accepted that after its first use, a mantle becomes extremely brittle and/or fragile because it is then simply a fine grid or lattice of sintered oxide material. However, at the time of installation it is a loose, floppy bag and it is usual to provide a tie yarn in the form of a high temperature resistant drawcord which can be used to secure the mantle in place. Such drawcords must not only have good performance at elevated temperatures, but they must also exhibit good handling properties and in particular, good knot strength.

The traditional material for the tie yarn or drawcord was an asbestos based cord. Substitutes for asbestos have included glass fiber yarns with an outer layer of cotton. However, these have poor knot strength, as well as poor performance at the elevated service temperatures encountered. Commercially-available glass fibers soften and/or melt at such temperatures.

A continuous filament glass fiber yarn with organic fibers such as acrylic, viscose and aramid staple fibers bonded to it in a generally parallel arrangement has also been tried, the organic component burning off in service to leave the glass core. However, knot strength is still a problem and aramid fibers are costly.

SUMMARY OF THE INVENTION

According to this invention an incandescent mantle tie cord comprises a continuous filament first core of a refractory fiber, a second core of another continuous filament yarn and an outer sheath of staple fibers wrapped about said first and second cores. Refractory fiber for present purposes means a fiber which will not ordinarily fuse together at the working temperature of a naturally aspirated liquified petroleum gas (LPG) flame. Working temperatures in the range of about750° C. to about 900° C. are typical of such LPG flames. A particularly preferred refractory fiber is silica. The staple fibers and the second core of another continuous filament yarn are preferably both of regenerated cellulose. The staple fibres are applied to the first and second cores by winding and/or wrapping them about the cores, for example by use of the DREF spinning process. The resultant cord may be treated with a binder to reduce hairiness. This is important in order to facilitate subsequent processing by automatic threading machinery. The binder may be an aqueous acrylic copolymer such as a polyvinyl acetate ethylene oxide copolymer solution or dispersion.

Starch or acrylic polymer dispersions may also be used. Viscose is a preferred regenerated cellulose material.

The tie cord of this invention can be coloured, for example by including a dyestuff in the binder, though it is also possible to dye the staple fibers. Colouring the tie cord facilitates its identification by a user.

It has been found that the tie cord of this invention exhibits good processing characteristics and in particular that it has sufficient integrity to hold a mantle in place until its shape is effectively fixed by the heat developed in use, even though the regenerated cellulose carbonises to a very weak or even non-existent state after a fairly short time.

DESCRIPTION OF THE PREFERRED EMBODIMENT(S)

In order that the invention be better understood a preferred embodiment of it will now be described by way of example with reference to the accompanying Figure which is a perspective view of a short length of mantle tie cord. In the Figure, a mantle tie cord comprises a continuous, multifilament refractory fiber core 11, a second core 12 of another continuous multifilament yarn and an outer sheath 10 comprised of staple fibers 13 wrapped onto the core yarns 11 and 12. To further illustrate the present invention, two Examples will now be presented.

EXAMPLE 1

(prior art product)

A 6 ply 136 tex continuous filament silica yarn was fed as a core thread to the spinning drums of a DREF (TM) 3 spinning machine, at a feed rate of 100m/minute. It was covered with about 204 tex of staple viscose fibers to give a yarn of about 340 tex. This was then passed at 12 m/minute through a bath of an aqueous acrylic copolymer emulsion (2.5 weight % solids). The treated strand was passed through squeeze rollers to regulate the liquid pick-up to about 100% by weight. The strand was then dried by infra-red heating to give a final yarn density on the order of 350 tex. The yarn had a mean tensile strength of 23 Newtons. This mean only fell to 20 Newtons (a strength retention of 86%) when tested in the knotted state in accordance with British Standard 1932, part 2 (1989), (equivalent to ASTM D 3217). However, this high mean strength disguised an unacceptably wide spread of results, with 20% at levels below 13 Newtons. The yarn was evidently of very variable consistency as regards its properties.

In fact, this example was immediately rejected as a mantle tie cord by a major manufacturer of incandescent mantles, on the basis of in-house knotting and burning trials, which indicated commercially and technically unacceptable performance in a mantle environment.

EXAMPLE 2

The 136 tex silica yarn of Example 1 and a 122 tex continuous filament viscose yarn were assembled side by side and fed to the same DREF (TM) 3 machine as in Example 1 where they were covered with only 82 tex of staple viscose fibers to form a sheath. The result was another 340 tex yarn which was treated as in Example 1 to yield a 350 tex yarn of mean tensile strength 48 Newtons. On repeating the strength test, in a knotted state, before, the strength fell more sharply, to a mean of 27 Newtons. But this apparent fall of 57% was deceptive.

There was only a narrow spread of tensile strengths in the knotted state, with the lowest individual value being 25 Newtons.

However, on testing by the same major manufacturer of mantles, the yarn of Example 2passed in-house knotting and burning tests. It also processed well on automatic threading equipment. It was clear that the yarn according to the invention had greater consistency and/or uniformity of properties, resulting in a commercially and technically acceptable product.

We claim:

1. A mantle tie cord comprising a continuous multifilament first core of refractory fiber, a second core of another continuous multifilament yarn and an outer sheath of staple fibers wrapped about said first and second cores, wherein the periphery of said first core is adjacent to the periphery of said second core.

2. A mantle tie cord according to claim 1 wherein the refractory fiber is silica.

3. A mantle tie cord according to claim 1 wherein said outer sheath comprises regenerated cellulose fibers.

4. A mantle tie cord according to claim 3 wherein the second core is of regenerated cellulose.

5. A mantle tie cord according to claim 4 further comprising a binder composition.

6. A mantle tie cord according to claim 5 wherein the binder is a polyvinyl acetate composition, or starch, or an acrylic polymer dispersion.

7. A mantle tie cord according to claim 6 wherein the binder further comprises a dye.

* * * * *

UNITED STATES PATENT AND TRADEMARK OFFICE

CERTIFICATE OF CORRECTION

PATENT NO. : 5,701,730

DATED : Dec. 30, 1997

INVENTOR(S) : Kennedy, et al

It is certified that error appears in the above-indentified patent and that said Letters Patent is hereby corrected as shown below:

Column 2, line 15, insert the following heading and description:
—BRIEF DESCRIPTION OF THE DRAWING—
—Figure 1 shows a perspective view of the mantle tie cord of the present invention.—
Column 2, lines 30 and 32, the heading should read as follows:
—EXAMPLE 1(prior art product)—
Column 2, line 65, insert —as— before "before"
Column 3, lines 5 and 6 should be joined together.

Signed and Sealed this

Eleventh Day of August 1998

Bruce Lehman

*Attest:*

BRUCE LEHMAN

*Attesting Officer*

*Commissioner of Patents and Trademarks*